US012297629B2

(12) United States Patent
Bai et al.

(10) Patent No.: US 12,297,629 B2
(45) Date of Patent: May 13, 2025

(54) WATER OUTLET PANEL, WATER OUTLET PANEL ASSEMBLY CONFIGURED TO BE CONNECTED TO FAUCET, AND FAUCET

(71) Applicant: Xiamen Lota International Co., Ltd., Fujian (CN)

(72) Inventors: Shuanglin Bai, Fujian (CN); Liming Ye, Fujian (CN); Chuanbao Zhu, Fujian (CN)

(73) Assignee: Xiamen Lota International Co., Ltd., Xiamen (CN)

( * ) Notice: Subject to any disclaimer, the term of this patent is extended or adjusted under 35 U.S.C. 154(b) by 0 days.

(21) Appl. No.: 18/530,680

(22) Filed: Dec. 6, 2023

(65) Prior Publication Data

US 2025/0052043 A1 Feb. 13, 2025

(30) Foreign Application Priority Data

Aug. 11, 2023 (CN) ..... 202311017383.9

(51) Int. Cl.
*E03C 1/04* (2006.01)

(52) U.S. Cl.
CPC ..... *E03C 1/0401* (2013.01); *E03C 1/0403* (2013.01)

(58) Field of Classification Search
CPC ..... E03C 1/04; E03C 1/0401; E03C 1/0403
See application file for complete search history.

(56) References Cited

U.S. PATENT DOCUMENTS

| | | | | |
|---|---|---|---|---|
| 3,448,768 | A * | 6/1969 | Keller | F16K 19/006 29/890.141 |
| 5,185,893 | A * | 2/1993 | Lin | E03C 1/023 137/597 |
| 5,797,151 | A * | 8/1998 | Ko | E03C 1/04 4/677 |
| 7,269,864 | B2 * | 9/2007 | Brown | E03C 1/0401 4/678 |
| 9,951,501 | B2 * | 4/2018 | Chen | E03C 1/023 |
| 10,156,062 | B2 * | 12/2018 | Mao | E03C 1/0403 |
| 2012/0097276 | A1 * | 4/2012 | Tzeng | F16K 19/006 137/603 |
| 2012/0097279 | A1 * | 4/2012 | Ko | E03C 1/04 137/801 |
| 2015/0159353 | A1 * | 6/2015 | Biju Duval | E03C 1/04 4/678 |

* cited by examiner

*Primary Examiner* — Reinaldo Sanchez-Medina
(74) *Attorney, Agent, or Firm* — Cooper Legal Group, LLC

(57) ABSTRACT

A water outlet panel, a water outlet panel assembly configured to be connected to a faucet, and the faucet are provided. The water outlet panel comprises a panel seat, a water outlet seat, and a disassembly mechanism. The water outlet seat comprises one or more water outlet ports, and the water outlet seat is detachably disposed on a front side of the panel seat. The water outlet seat is fixedly disposed with a connecting column, and the connecting column is slidably disposed on the panel seat along a detachment direction of the water outlet seat. The disassembly mechanism is operatively and movably disposed on the panel seat to be configured to correspondingly push the connecting column to move so as to achieve detachment of the water outlet seat.

17 Claims, 11 Drawing Sheets

WATER OUTLET PANEL, WATER OUTLET PANEL ASSEMBLY CONFIGURED TO BE CONNECTED TO FAUCET, AND FAUCET

RELATED APPLICATIONS

This application claims priority to Chinese patent application number 202311017383.9, filed on Aug. 11, 2023. Chinese patent application number 202311017383.9 is incorporated herein by reference.

FIELD OF THE DISCLOSURE

The present disclosure relates to a water outlet panel, a water outlet panel assembly configured to be connected to faucet, and a faucet.

BACKGROUND OF THE DISCLOSURE

Existing water outlet panels comprise a top wall, a surrounding wall, and a bottom wall. The top wall of the water outlet panel functions as a decorative panel. The top wall can have the same color and material as the faucet, and the bottom wall is parallel to the top wall. The bottom wall is placed on a countertop of a sink. The water outlet panel and a faucet body of the faucet can be arranged separately, and the water outlet panel can be arranged separately from the faucet body at different positions on the countertop of the sink to achieve a wider range of water outlet arrangements. The water outlet panel comprises a water outlet port arranged on the surrounding wall. The water outlet port is arranged on a long side of the surrounding wall. The water outlet port comprises a plurality of water outlet holes arranged at intervals along the long side. The water outlet port achieves a larger width of water flow through the plurality of water outlet holes, and the water flow falls into the sink in a horizontal throwing motion. However, in some areas with hard water, it is easy for scale to form on the water outlet port, thus blocking the water outlet port. The water outlet panel has an integrated structure and is not easy to remove and clean.

BRIEF SUMMARY OF THE DISCLOSURE

The present disclosure provides a water outlet panel, a water outlet panel assembly configured to be connected to a faucet, and the faucet to solve the deficiencies in the background.

In order to solve the technical problem, a first technical solution of the present disclosure is as follows.

A water outlet panel configured to be detachably connected to a faucet, comprises a panel seat, a water outlet seat, and a disassembly mechanism. The water outlet seat comprises one or more water outlet ports, and the water outlet seat is detachably disposed on a front side of the panel seat. The water outlet seat is fixedly disposed with a connecting column, and the connecting column is slidably disposed on the panel seat along a detachment direction of the water outlet seat. The disassembly mechanism is operatively and movably disposed on the panel seat to be configured to correspondingly push the connecting column to move so as to achieve detachment of the water outlet seat.

In a preferred embodiment, the connecting column comprises a connecting member detachably connected to the panel seat, and the connecting member is configured to be in a connected state connected to the panel seat and a non-connected state disconnected from the panel seat. When the disassembly mechanism is moved, the disassembly mechanism at least drives the connecting member to change from the connected state to the non-connected state.

In a preferred embodiment, the connecting member comprises at least one hook member, and the disassembly mechanism comprises at least one pushing slope. The panel seat comprises at least one buckling surface, and the at least one hook member is configured to move in a radial direction of the connecting member to be changed between the connected state and the non-connected state. When in the connected state, the at least one hook member is snap-connected to the at least one buckling surface, and when in the non-connected state, the at least one hook member is disconnected from the at least one buckling surface. The disassembly mechanism is configured to be moved so that the at least one pushing slope pushes the at least one hook member to move along the radial direction of the connecting member.

In a preferred embodiment, the at least one hook member is disposed on an outside of the connecting column in the radial direction of the connecting member, and an inside of the connecting column in the radial direction of the connecting member comprises a middle hole. The disassembly mechanism comprises a middle column, and the at least one pushing slope is located on an outside of the middle column in a radial direction of the middle column. The middle column is slidably disposed in the middle hole.

In a preferred embodiment, the at least one hook member is moved radially inward to release a connection to the at least one buckling surface.

In a preferred embodiment, the disassembly mechanism is disposed on a rear side of the panel seat, and the disassembly mechanism is moved along an axial direction of the disassembly mechanism to push the water outlet seat to move forward.

In a preferred embodiment, the water outlet seat comprises abase body, a water outlet body, and two rotating shaft bodies. The two rotating shaft bodies are disposed on the base body, and the water outlet body comprises the one or more water outlet ports. Two ends of the water outlet body are rotatably disposed on the two rotating shaft bodies so that the water outlet body is configured to swing up and down.

In a preferred embodiment, the water outlet body extends along a length direction of the panel seat, and the one or more water outlet ports discharge water forward. The water outlet body comprises a paddle, and the paddle operatively drives the water outlet body to swing up and down to a preset angle.

In a preferred embodiment, a water passage penetrates through the water outlet body along a length direction of the water outlet body, and the water passage is connected to the one or more water outlet ports. Two ends of the water passage are respectively rotatably connected to the two rotating shaft bodies, and at least one of the two rotating shaft bodies comprises a rotating shaft channel. The rotating shaft channel is connected to an external water source.

In a preferred embodiment, the base body comprises a front opening and two rear openings, and the two rear openings correspond to two ends of the front opening respectively. The water outlet body is disposed in the front opening, and the two rotating shaft bodies are configured to be mounted from the two rear openings to be inserted into the water passage. The two rotating shaft bodies and the water passage are hermetically connected together through a sealing ring.

In a preferred embodiment, a control member is provided. The control member comprises a handle disposed on a top wall of the water outlet panel, a control valve body disposed in the water outlet panel, and a water inlet pipe disposed on a bottom wall of the water outlet panel. The control valve body is connected to the water inlet pipe and one of the two rotating shaft bodies, and the handle is configured to control the water inlet pipe to be or not to be in communication with the one of the two rotating shaft bodies.

In a preferred embodiment, the disassembly mechanism is disposed on a rear side of the panel seat, and the water outlet seat is fixedly disposed with at least two of the connecting columns. The water outlet panel is disposed with at least two of the disassembly mechanisms, and the at least two of the disassembly mechanisms respectively correspond to the at least two of the connecting columns.

A second technical solution of the present disclosure is as follows.

A water outlet panel assembly configured to be connected to a faucet comprises the water outlet panel, and an adapter member. The water outlet panel is detachably connected to a faucet body of the faucet, and the adapter member comprises a water inlet, a first water outlet, and a second water outlet. The water inlet and the first water outlet are detachably connected to a water outlet pipe of the faucet, and the second water outlet is in communication with the one or more water outlet ports.

In a preferred embodiment, the water outlet panel assembly further comprises a control member, and the control member is connected to the second water outlet and the one or more water outlet ports of the water outlet panel to be configured to control the second water outlet alternatively to be or not to be in communication with the one or more water outlet ports. When the second water outlet is controlled to be in communication with the one or more water outlet ports by the control member, the first water outlet is controlled to be closed by the adapter member, and when the second water outlet is controlled not to be in communication with the one or more water outlet ports by the control member, the first water outlet is controlled to be opened by the adapter member. The adapter member comprises a cavity, a movable switching member, and an elastic member. The cavity is respectively connected to the water inlet, the first water outlet, and the second water outlet, and the movable switching member is movably disposed in the cavity to move between a first position for blocking the first water outlet and a second position for unblocking the first water outlet, and the elastic member abuts the movable switching member. When the second water outlet is controlled not to be in communication with the one or more water outlet ports by the control member, the movable switching member is pushed by a water pressure in the cavity to overcome an elastic force of the elastic member so as to enable the movable switching member to be moved to the second position. When the second water outlet is controlled to be in communication with the one or more water outlet ports by the control member, the movable switching member is pushed by the elastic force of the elastic member to be moved to the first position. The movable switching member comprises a first bearing surface facing the second water outlet and a second bearing surface facing the first water outlet, and an area of the first bearing surface is larger than an area of the second bearing surface.

In a preferred embodiment, the water outlet panel comprises a through hole penetrating therethrough, and a bottom of the faucet body of the faucet is configured to be connected to the through hole.

A third technical solution of the present disclosure is as follows.

The faucet comprising the water outlet panel assembly.

Compared with the existing techniques, the technical solution has the following advantages.

The water outlet panel configured to be detachably connected to the faucet, comprises the panel seat, the water outlet seat, and the disassembly mechanism. The water outlet seat comprises the one or more water outlet ports, the water outlet seat is detachably disposed on the front side of the panel seat, the water outlet seat is fixedly disposed with the connecting column, the connecting column is slidably disposed on the panel seat along a detachment direction of the water outlet seat, and the disassembly mechanism is operatively and movably disposed on the panel seat to be configured to correspondingly push the connecting column to move so as to achieve detachment of the water outlet seat. The water outlet seat and panel seat of the water outlet panel have a separate structure and can be easily disassembled and assembled through the disassembly mechanism, which is more convenient.

The disassembly mechanism is disposed on a rear side of the panel seat. The disassembly mechanism moves along the axial direction to push the water outlet seat to move forward. The user can directly press the distal end of the disassembly mechanism, so that the disassembly mechanism directly pushes the water outlet seat to move forward. The thrust is directly transmitted to the water outlet seat, which is more labor-saving.

DETAILED DESCRIPTION OF THE EMBODIMENTS

Figure 1:
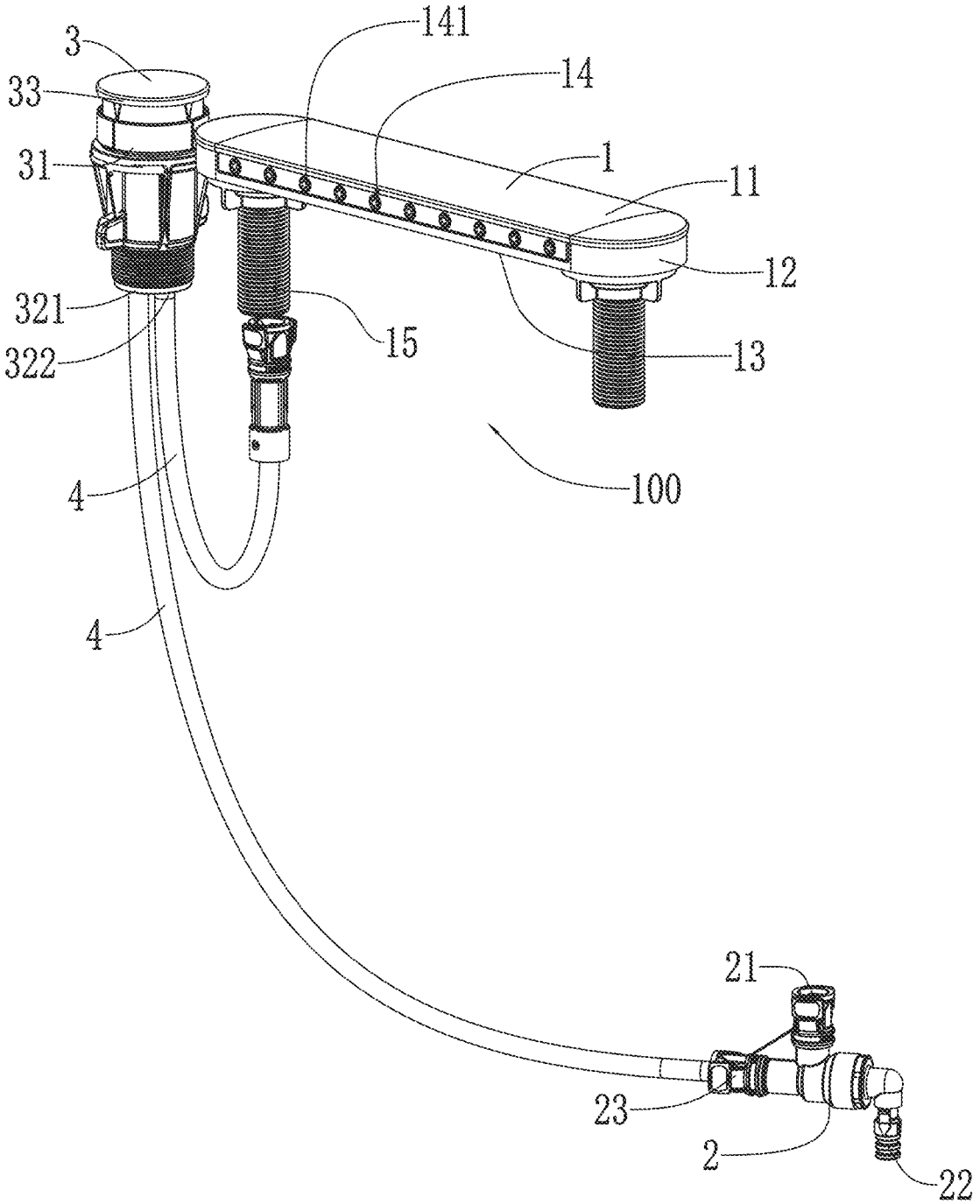
FIG. 1 illustrates a perspective view of a water outlet panel assembly in a preferred embodiment of the present disclosure.
Figure 2:
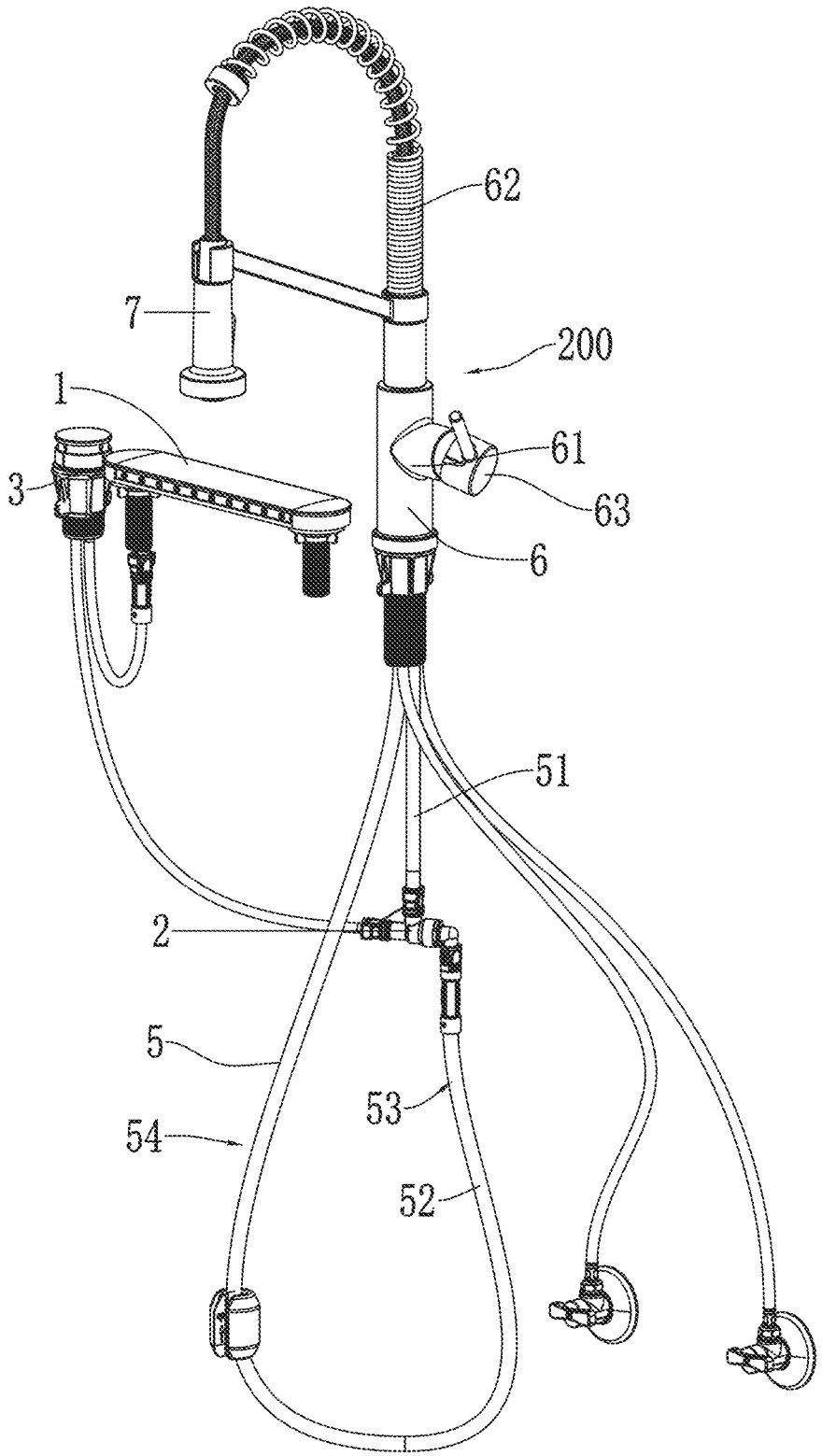
FIG. 2 illustrates a perspective view of the water outlet panel assembly connected to a pull-out faucet in a preferred embodiment of the present disclosure.
Figure 3:
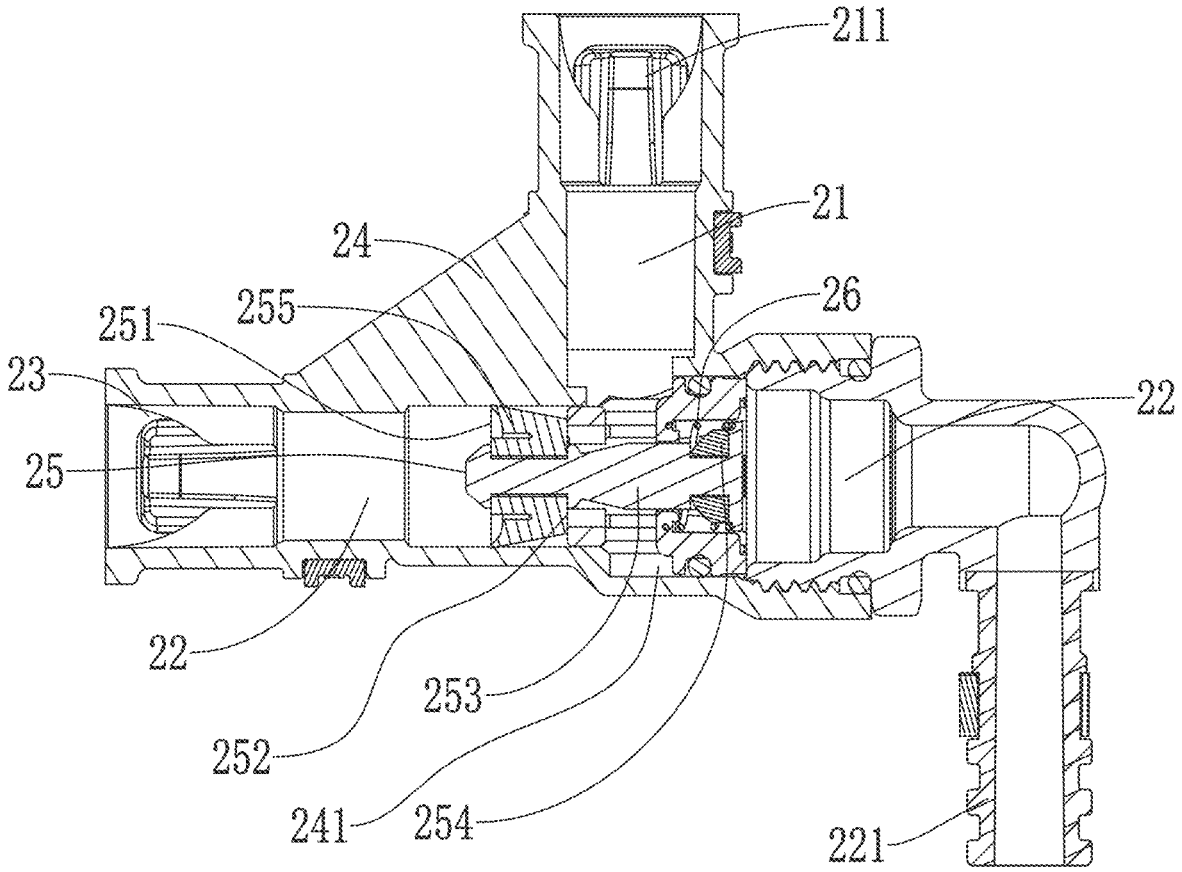
FIG. 3 illustrates a cross-sectional view of an adapter member in a preferred embodiment of the present disclosure.

The present disclosure will be further described below in combination with the accompanying drawings and embodiments.

Referring to FIGS. 1-6, a water outlet panel assembly 100 configured to be connected to a faucet 200 is provided, and the water outlet panel assembly 100 comprises a water outlet panel 1, an adapter member 2, and a control member 3.

The water outlet panel 1 comprises a top wall 11, a surrounding wall 12, and a bottom wall 13. The water outlet panel 1 is substantially in an oval shape. The top wall 11 plays a role of a decoration panel, and the top wall 11 has the same color and material as the faucet 200. The bottom wall 13 is parallel to the top wall 11, and the bottom wall 13 is used for being placed on a countertop of a water tank (i.e., a sink). The water outlet panel 1 is detachably connected to a faucet body 6 of the faucet 200, and the water outlet panel 1 and the faucet body 6 can be independently disposed at different positions of the countertop of the water tank to achieve water spraying of a larger range. The water outlet panel 1 comprises a water outlet port 14 disposed on the surrounding wall 12, and the water outlet port 14 is arranged on a long side (i.e., extending along a length direction of the water outlet panel 1) of the surrounding wall 12. The water outlet port 14 comprises a plurality of water outlet holes 141 disposed along the long side at intervals, and the water outlet port 14 forms a water flow with larger width through the plurality of water outlet holes 141 to achieve large-area water spraying to fall into the water tank in a horizontal projectile motion.

The faucet 200 comprises a water outlet pipe 5 and the faucet body 6, and the faucet body 6 comprises a faucet housing 61, a bent tube 62, and a valve assembly 63. The faucet housing 61 has a three-way pipe structure, and a bottom of the faucet housing 61 is disposed on the countertop of the water tank. The bent tube 62 is connected to a top of the faucet housing 61. The valve assembly 63 is disposed in the faucet housing 61, and the valve assembly 63 is connected to a hot water pipe and a cold water pipe and is configured to be controlled to form mixed water. A first end of the water outlet pipe 5 is connected to a water outlet of the valve assembly 63 (i.e., a water outlet of the faucet 200), and a second end of the water outlet pipe 5 is connected to a water outlet terminal 7 after passing through the faucet housing 61 and the bent tube 62. A user can grasp the water outlet terminal 7 to pull out the water outlet terminal 7, and the user can change a water outlet direction of the water outlet terminal 7.

The adapter member 2 comprises a water inlet 21, a first water outlet 22, and a second water outlet 23. The water inlet 21 and the first water outlet 22 are detachably connected to the water outlet pipe 5 of the faucet 200, and the control member 3 is connected to the second water outlet 23 and the water outlet port 14 of the water outlet panel 1 to be configured to control the second water outlet 23 alternatively to be or not to be in communication with the water outlet port 14. When the second water outlet 23 is controlled to be in communication with the water outlet port 14 by the control member 3, the first water outlet 22 is controlled to be closed by the adapter member 2. When the second water outlet 23 is controlled not to be in communication with the water outlet port 14 by the control member 3, the first water outlet 22 is controlled to be opened by the adapter member 2.

The control member 3 comprises a control housing 31 and a control valve body disposed in the control housing 31. The control valve body comprises a valve inlet 321 and a valve outlet 322, and the control valve body is an on-off valve. The valve inlet 321 is connected to the second water outlet 23 through a first one of water inlet pipes 4, the bottom wall 13 of the water outlet panel 1 comprises a water inlet port 15 connected to the water outlet port 14, and the valve outlet 322 is connected to the water inlet port 15 through a second one of the water inlet pipes 4. The control member 3 further comprises a handle 33 disposed on the control housing 31 and operatively coupled to the control valve body, and the user can control the valve inlet 321 alternatively to be or not to be in communication with the valve outlet 322 by operating the handle 33. In some simple alternatives, the control valve body may also be a solenoid valve or the like, and the handle 33 may be a touch switch or the like. In addition, referring to FIG. 6, the control member 3 may also be directly disposed on the top wall 11 of the water outlet panel 1, and the control housing 31 is integrally formed with the water outlet panel 1, but the disclosure is not limited thereto.

The adapter member 2 comprises an adapter housing 24 defining a cavity 241, and the adapter housing 24 comprises the water inlet 21, the first water outlet 22, and the second water outlet 23. The water inlet 21 of the adapter member 2 is disposed with a first one of first connectors 211, and the first water outlet 22 of the adapter member 2 is disposed with a first one of second connectors 221. The water outlet pipe 5 comprises a first pipe body 51 and a second pipe body 52. A first end of the first pipe body 51 is connected to the water outlet of the faucet 200, and a second end of the first pipe body 51 is disposed with a second one of the second connectors 221. A first end of the second pipe body 52 is connected to the water outlet terminal 7 of the faucet 200, and a second end of the second pipe body 52 is disposed with a second one of the first connectors 211. The first connectors 211 are configured to be detachably connected to the second connectors 221. Accordingly, the water outlet panel assembly 100 may be detached from or connected to the water outlet pipe 5, and the second one of the second connectors 221 at the second end of the first pipe body 51 may be connected to the second one of the first connectors 211 at the second end of the second pipe body 52 when the water outlet panel assembly 100 is detached from the water outlet pipe 5. When the water outlet panel assembly 100 is connected to the water outlet pipe 5, the second one of the second connectors 221 at the second end of the first pipe body 51 is connected to the first one of the first connectors 211 at the water inlet 21, and the second one of the first connectors 211 at the second end of the second pipe body 52 is connected to the first one of the second connectors 221 at the second water outlet 23. Therefore, the adapter member 2 can be conveniently connected to the water outlet pipe 5. The first connectors 211 and the second connectors 221 may be conventional connection structures, such as snap connection structures, screw connection structures, etc.

The adapter member 2 further comprises a movable switching member 25 and an elastic member 26. The cavity 241 is respectively connected to the water inlet 21, the first water outlet 22, and the second water outlet 23. The movable switching member 25 is movably disposed in the cavity 241 to move between a first position for blocking the first water outlet 22 and a second position for unblocking the first water outlet 22. The elastic member 26 abuts the movable switching member 25. When the second water outlet 23 is controlled not to be in communication with the water outlet port 14 by the control member 3, a water pressure in the cavity 241 pushes the movable switching member 25 to overcome an elastic force of the elastic member 26 so as to enable the movable switching member 25 to be moved to the second position. When the second water outlet 23 is controlled to be in communication with the water outlet port 14 by the control member 3, the elastic force of the elastic member 26 pushes the movable switching member 25 to be moved to the first position. When the second water outlet 23 is controlled not to be in communication with the water outlet port 14 by the control member 3, a water flow between the second water outlet 23 and the water outlet port 14 is stopped, and the water pressure in the cavity 241 pushes the movable switching member 25 to overcome the elastic force so as to enable the movable switching member 25 to be moved to the second position. When the second water outlet 23 is controlled to be in communication with the water outlet port 14 by the control member 3, the water flow flows between the second water outlet 23 and the water outlet port 14, and the elastic force of the elastic member 26 pushes the movable switching member 25 to be moved to the first position.

The movable switching member 25 comprises a first bearing surface 251 facing the second water outlet 23 and a second bearing surface 252 facing the first water outlet 22, and an area of the first bearing surface 251 is larger than an area of the second bearing surface 252. When the second water outlet 23 is not in communication with the water outlet port 14, a water pressure in the second water outlet 23 is the same as a water pressure in the cavity 241, and the area of the first bearing surface 251 is larger than the area of the second bearing surface 252, so that the water pressure acting on the first bearing surface 251 is larger than the water pressure acting on the second bearing surface 252 to enable the movable switching member 25 to be pushed.

The movable switching member 25 comprises a shaft 253, a first sealing gasket 254, and a second sealing gasket 255. The shaft 253 is moved to drive the first sealing gasket 254 to block the first water outlet 22, and the second sealing gasket 255 comprises the first bearing surface 251 and the second bearing surface 252. The first sealing gasket 254 and the second sealing gasket 255 are coaxially disposed at two ends of the shaft 253. In this embodiment, the cavity 241 comprises a first opening connected to the first water outlet 22 and a second opening connected to the second water outlet 23. The second bearing surface 252 may abut the second opening to block a connection between the cavity 241 and the second water outlet 23, and the first sealing gasket 254 may abut the first opening to block the first water outlet 22.

In this embodiment, the water outlet pipe 5 comprises a droop section 53 connected to the water outlet of the faucet 200 and a rising section 54 connected to the water outlet terminal 7 of the faucet 200. The water inlet 21 and the first water outlet 22 are detachably connected to the droop section 53 of the water outlet pipe 5 of the faucet 200. When the water outlet pipe 5 is pulled out, the rising section 54 rises and does not affect the droop section 53, so that loosening and other problems caused by frequent movement of the adapter member 2 can be prevented.

Figure 4:
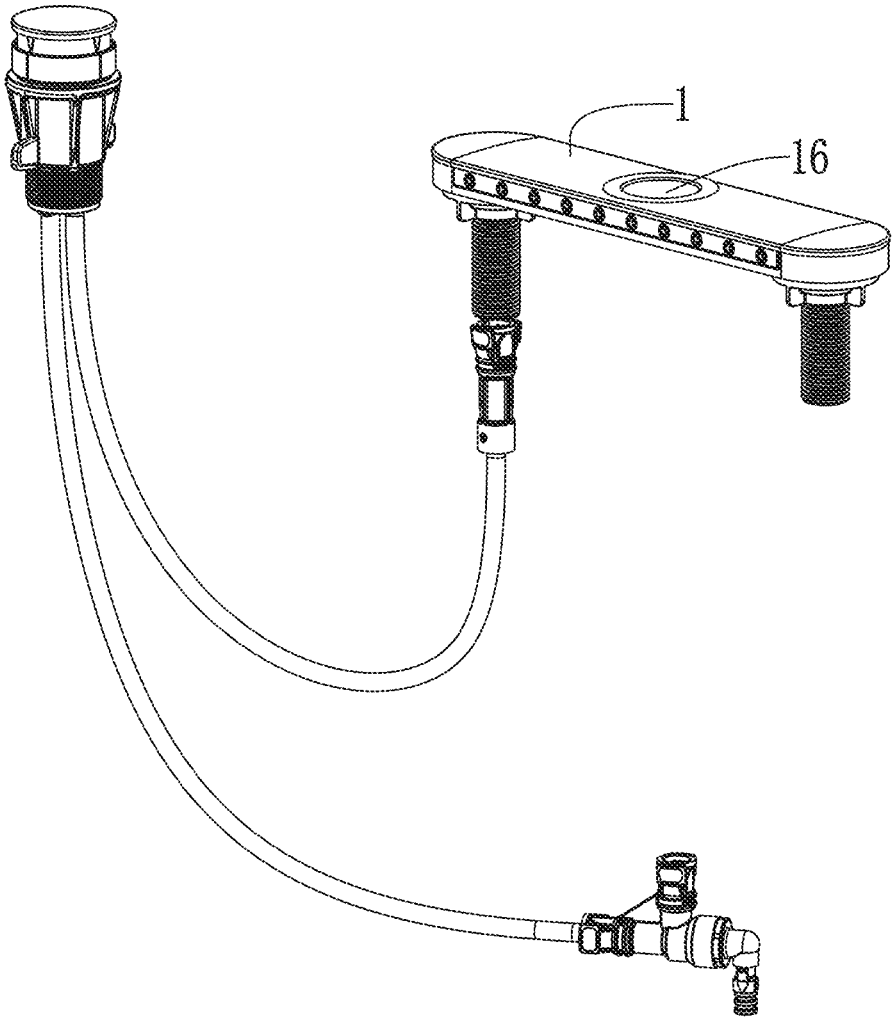
FIG. 4 illustrates a perspective view of a water outlet panel having a through hole in a preferred embodiment of the present disclosure.
Figure 5:
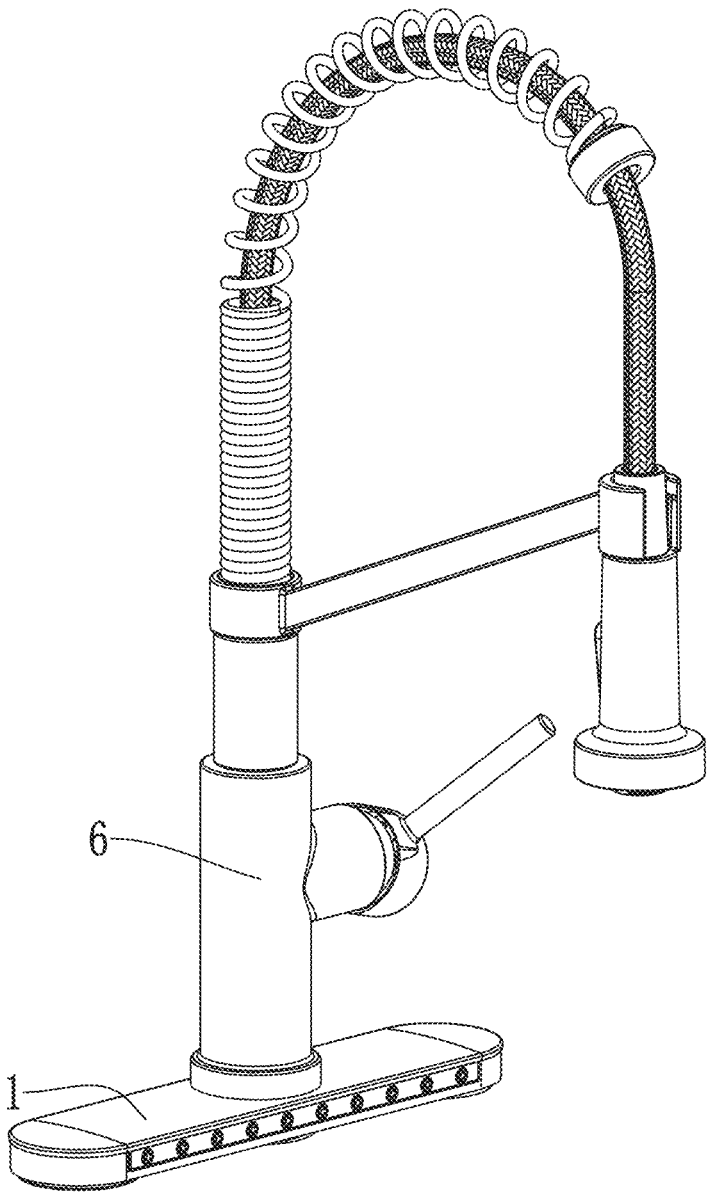
FIG. 5 illustrates a perspective view of the water outlet panel having the through hole and connected to the pull-out faucet in a preferred embodiment of the present disclosure.
Figure 6:
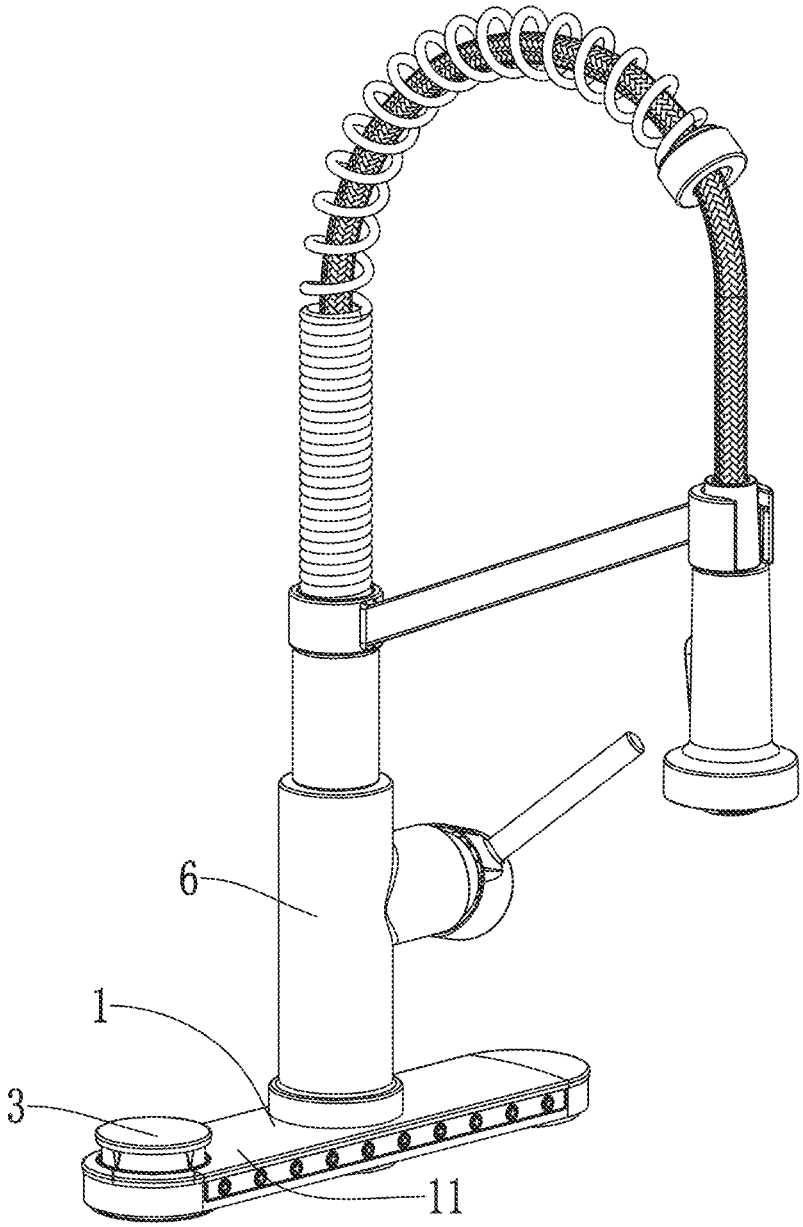
FIG. 6 illustrates a perspective view of the water outlet panel with a control member disposed thereon in a preferred embodiment of the present disclosure.
Figure 7:
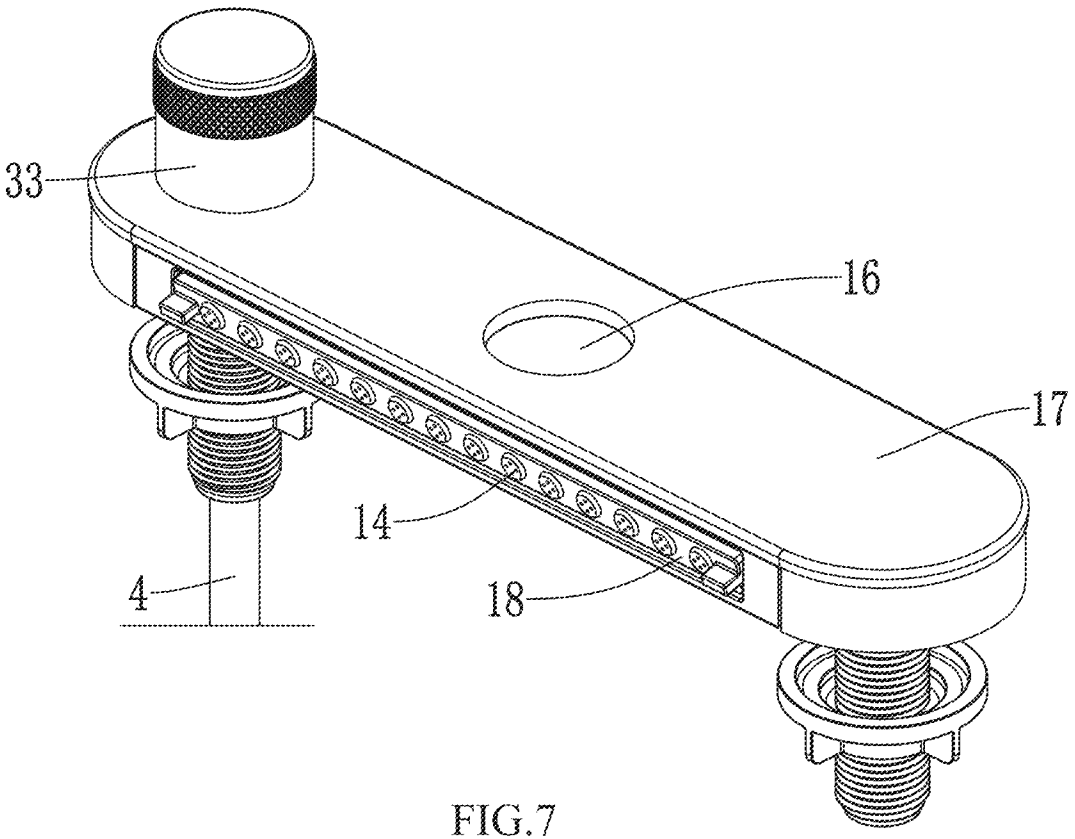
FIG. 7 illustrates a first perspective view of the water outlet panel with a detachable water outlet seat in a preferred embodiment of the present disclosure.
Figure 8:
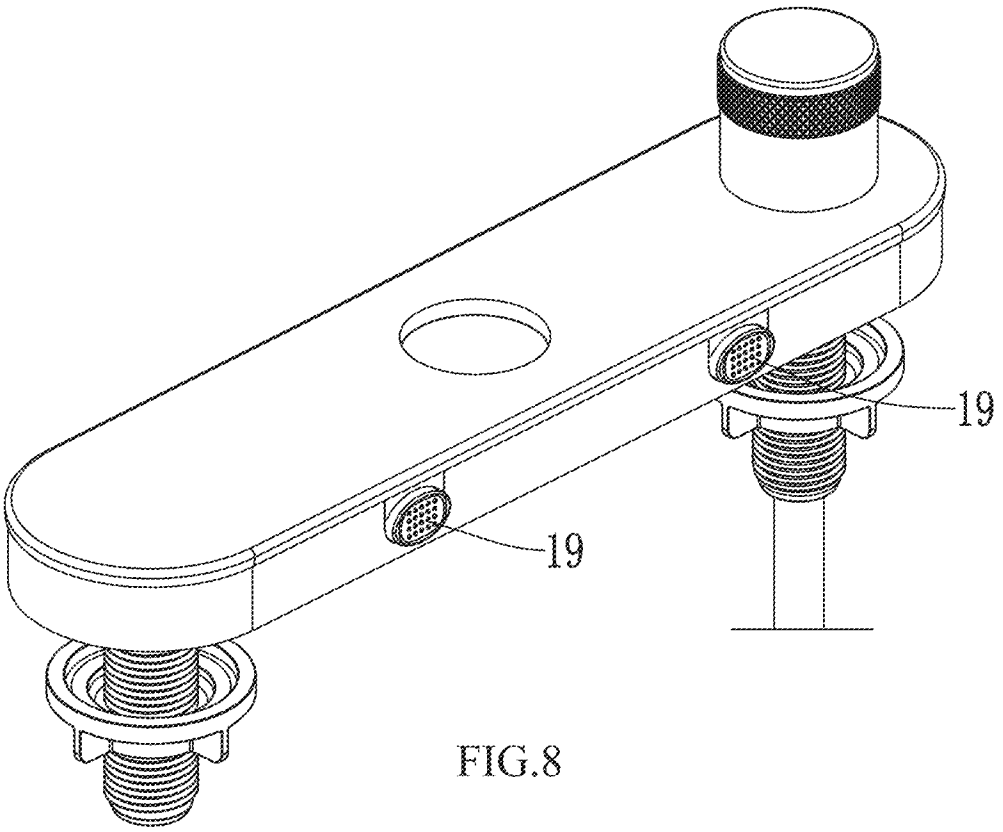
FIG. 8 illustrates a second perspective view of the water outlet panel with the detachable water outlet seat in a preferred embodiment of the present disclosure.
Figure 9:
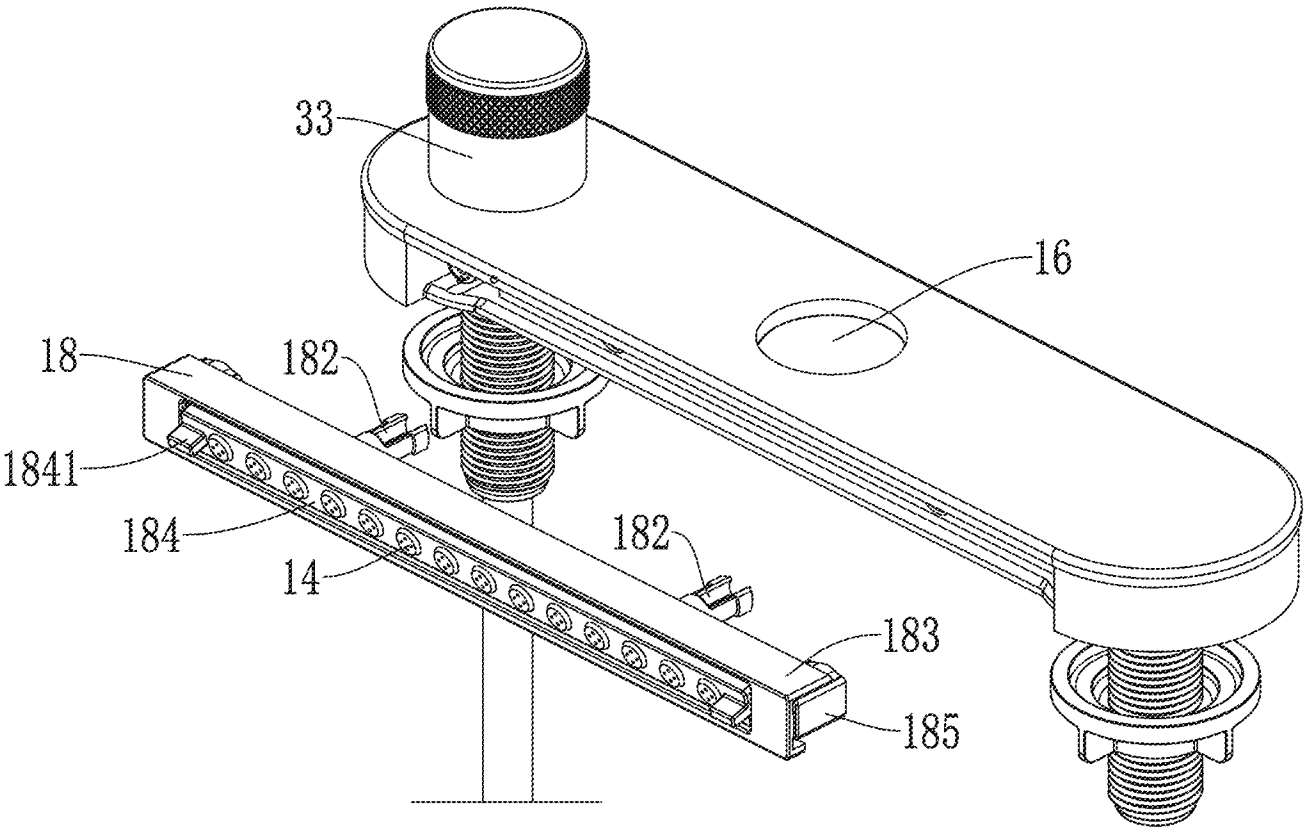
FIG. 9 illustrates a perspective exploded view of the water outlet panel with the detachable water outlet seat in a preferred embodiment of the present disclosure.
Figure 10:
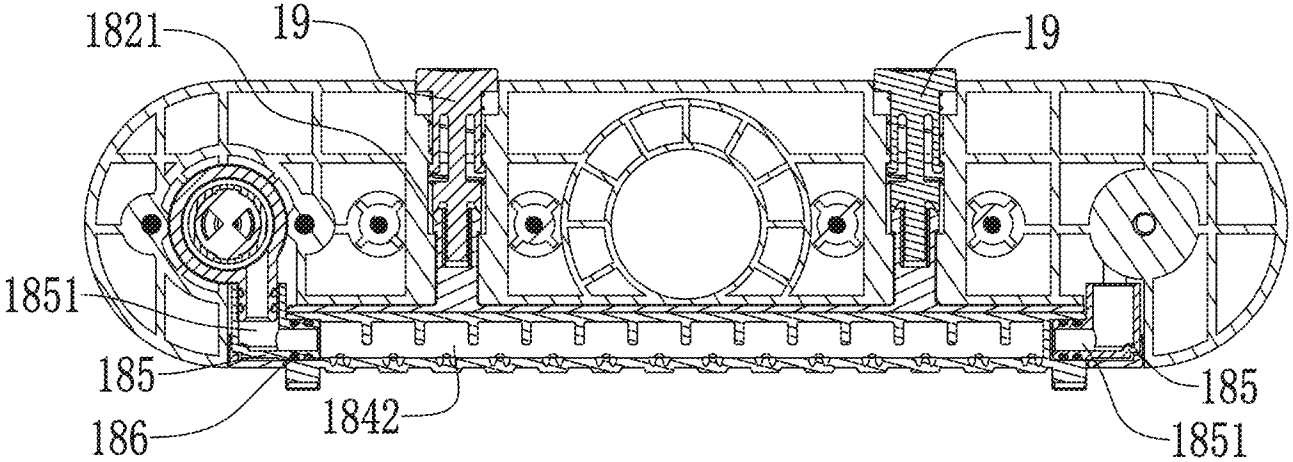
FIG. 10 illustrates a cross-sectional view of the water outlet panel with the detachable water outlet seat in a preferred embodiment of the present disclosure.
Figure 11:
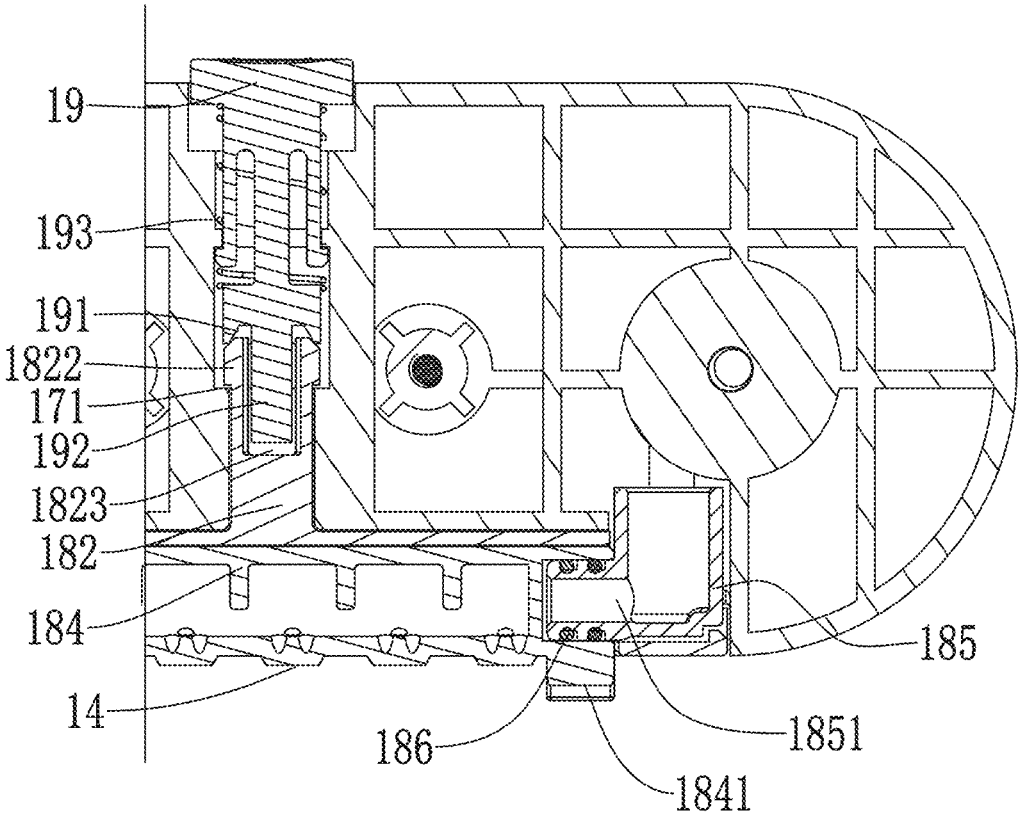
FIG. 11 illustrates an enlarged view of a portion of FIG. 10.

Referring to FIGS. 4-6, in some constructions, the water outlet panel 1 comprises a through hole 16 extending through the top wall 11 and the bottom wall 13, and the bottom of the faucet body 6 of the faucet 200 is adapted to be connected to the through hole 16. Of course, the water outlet panel 1 may not comprises the through hole 16 to achieve a clean appearance of the water outlet panel 1.

Referring to FIGS. 7-11, the water outlet panel 1 comprises a panel seat 17, a water outlet seat 18, and a disassembly mechanism 19. The water outlet seat 18 comprises the water outlet port 14, and the water outlet seat 18 is detachably disposed on a front side of the panel seat 17. The water outlet seat 18 is fixedly disposed with a connecting column 182. The connecting column 182 is slidably disposed on the panel seat 17 along a detachment direction of the water outlet seat 18. The disassembly mechanism 19 is operatively and movably disposed on the panel seat 17 to be configured to correspondingly push the connecting column 182 to move, so as to achieve detachment of the water outlet seat 18. Movement of the disassembly mechanism 19 can push the connecting column 182 to move, which facilitates the detachment of the water outlet seat 18 and facilitates the removal and cleaning of the water outlet seat 18.

The connecting column 182 comprises a connecting member 1821 detachably connected to the panel seat 17. The connecting member 1821 comprises a connected state connected to the panel seat 17 and a non-connected state disconnected from the panel seat 17. When the disassembly mechanism 19 is moved, the disassembly mechanism 19 at least drives the connecting member 1821 to change from the connected state to the non-connected state.

The connecting member 1821 comprises at least one hook member 1822, the disassembly mechanism 19 comprises at least one pushing slope 191, and the panel seat 17 comprises at least one buckling surface 171. The at least one hook member 1822 can move in a radial direction of the connecting member 1821 to be changed between the connected state and the non-connected state. When in the connected state, the at least one hook member 1822 is snap-connected to the at least one buckling surface 171, and when in the non-connected state, the at least one hook member 1822 is disconnected from the at least one buckling surface 171. The disassembly mechanism 19 can be moved so that the at least one pushing slope 191 pushes the at least one hook member 1822 to move along the radial direction of the connecting member 1821. The at least one hook member 1822 is disposed on an outside of the connecting column 182 in the radial direction of the connecting member 1821. An inside of the connecting column 182 in the radial direction of the connecting member 1821 comprises a middle hole 1823. The disassembly mechanism 19 comprises a middle column 192. The at least one pushing slope 191 is located on an outside of the middle column 192 in a radial direction of the middle column 192. The middle column 192 is slidably disposed in the middle hole 1823. The at least one hook member 1822 is moved radially inward to release a connection to the at least one buckling surface 171.

The disassembly mechanism 19 is disposed on a rear side of the panel seat 17. The disassembly mechanism 19 is moved along an axial direction of the disassembly mechanism 19 to push the water outlet seat 18 to move forward. A distal end of the disassembly mechanism 19 protrudes from or is flush with the rear side of the panel seat 17. The user can directly press the distal end of the disassembly mechanism 19 so that the disassembly mechanism 19 directly pushes the water outlet seat 18 to move forward. When the disassembly mechanism 19 is pressed, the at least one hook member 1822 is pushed radially inward by pushing of the at least one pushing slope 191 to release the connection to the at least one buckling surface 171. Then, the disassembly mechanism 19 accordingly pushes the water outlet seat 18 to move forward to be detached from the panel seat 17. A return spring 193 is disposed between the disassembly mechanism 19 and the panel seat 17. When an external force acting on the disassembly mechanism 19 is removed, the return spring 193 can push the disassembly mechanism 19 to return to an original position.

The water outlet seat 18 comprises a base body 183, a water outlet body 184, and two rotating shaft bodies 185. The two rotating shaft bodies 185 are disposed on the base body 183, and the water outlet body 184 comprises the water outlet port 14. Two ends of the water outlet body 184 are rotatably disposed on the two rotating shaft bodies 185 so that the water outlet body 184 is configured to swing up and down. The water outlet body 184 extends along a length direction of the panel seat 17, and the water outlet port 14 discharges water forward. The water outlet body 184 comprises a paddle 1841, and the paddle 1841 operatively drives the water outlet body 184 to swing up and down to a preset angle. In this embodiment, the water outlet body 184 comprises two of the paddles 1841, and the two of the paddles 1841 are disposed at two ends of the water outlet body 184.

A water passage 1842 penetrates through the water outlet body 184 along a length direction of the water outlet body 184, and the water passage 1842 is connected to the water outlet port 14. Two ends of the water passage 1842 are respectively rotatably connected to the two rotating shaft bodies 185. At least one of the two rotating shaft bodies 185 comprises a rotating shaft channel 1851, and the rotating shaft channel 1851 is connected to an external water source. The base body 183 comprises a front opening and two rear openings, and the two rear openings correspond to two ends of the front opening respectively. The water outlet body 184 is disposed in the front opening, and the two rotating shaft bodies 185 are configured to be mounted from the two rear openings to be inserted into the water passage 1842. The two rotating shaft bodies 185 and the water passage 1842 are hermetically connected together through a sealing ring 186.

In this embodiment, the water outlet seat 18 is fixedly disposed with at least two of the connecting columns 182, and the water outlet panel 1 is disposed with at least two of the disassembly mechanisms 19. The at least two of the disassembly mechanisms 19 respectively correspond to the at least two of the connecting columns 182.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A water outlet panel configured to be detachably connected to a faucet, comprising:

a panel seat, a water outlet seat, and a disassembly mechanism, wherein:

the water outlet seat comprises one or more water outlet ports, the water outlet seat is detachably disposed on a front side of the panel seat, the water outlet seat is fixedly disposed with a connecting column, the connecting column is slidably disposed on the panel seat along a detachment direction of the water outlet seat, and the disassembly mechanism is operatively and movably disposed on the panel seat to be configured to correspondingly push the connecting column to move so as to achieve detachment of the water outlet seat.

2. The water outlet panel according to claim 1, wherein:

the connecting column comprises a connecting member detachably connected to the panel seat, the connecting member is configured to be in a connected state connected to the panel seat and a non-connected state disconnected from the panel seat, and when the disassembly mechanism is moved, the disassembly mechanism at least drives the connecting member to change from the connected state to the non-connected state.

3. The water outlet panel according to claim 2, wherein:

the connecting member comprises at least one hook member, the disassembly mechanism comprises at least one pushing slope, the panel seat comprises at least one buckling surface, the at least one hook member is configured to move in a radial direction of the connecting member to be changed between the connected state and the non-connected state, when in the connected state, the at least one hook member is snap-connected to the at least one buckling surface, when in the non-connected state, the at least one hook member is disconnected from the at least one buckling surface, and the disassembly mechanism is configured to be moved so that the at least one pushing slope pushes the at least one hook member to move along the radial direction of the connecting member.

4. The water outlet panel according to claim 3, wherein:

the at least one hook member is disposed on an outside of the connecting column in the radial direction of the connecting member, an inside of the connecting column in the radial direction of the connecting member comprises a middle hole, the disassembly mechanism comprises a middle column, the at least one pushing slope is located on an outside of the middle column in a radial direction of the middle column, and the middle column is slidably disposed in the middle hole.

5. The water outlet panel according to claim 3, wherein:

the at least one hook member is moved radially inward to release a connection to the at least one buckling surface.

6. The water outlet panel according to claim 1, wherein:

the disassembly mechanism is disposed on a rear side of the panel seat, and the disassembly mechanism is moved along an axial direction of the disassembly mechanism to push the water outlet seat to move forward.

7. The water outlet panel according to claim 1, wherein:

the water outlet seat comprises a base body, a water outlet body, and two rotating shaft bodies, the two rotating shaft bodies are disposed on the base body, the water outlet body comprises the one or more water outlet ports, and two ends of the water outlet body are rotatably disposed on the two rotating shaft bodies so that the water outlet body is configured to swing up and down.

8. The water outlet panel according to claim 7, wherein:

the water outlet body extends along a length direction of the panel seat, the one or more water outlet ports discharge water forward, the water outlet body comprises a paddle, and the paddle operatively drives the water outlet body to swing up and down to a preset angle.

9. The water outlet panel according to claim 7, wherein:

a water passage penetrates through the water outlet body along a length direction of the water outlet body, the water passage is connected to the one or more water outlet ports, two ends of the water passage are respectively rotatably connected to the two rotating shaft bodies, at least one of the two rotating shaft bodies comprises a rotating shaft channel, and the rotating shaft channel is connected to an external water source.

10. The water outlet panel according to claim 9, wherein:

the base body comprises a front opening and two rear openings, the two rear openings correspond to two ends of the front opening respectively, the water outlet body is disposed in the front opening, the two rotating shaft bodies are configured to be mounted from the two rear openings to be inserted into the water passage, and the two rotating shaft bodies and the water passage are hermetically connected together through a sealing ring.

11. The water outlet panel according to claim 9, further comprising:

a control member, wherein:

the control member comprises a handle disposed on a top wall of the water outlet panel, a control valve body disposed in the water outlet panel, and a water inlet pipe disposed on a bottom wall of the water outlet panel, the control valve body is connected to the water inlet pipe and one of the two rotating shaft bodies, and the handle is configured to control the water inlet pipe to be or not to be in communication with the one of the two rotating shaft bodies.

12. The water outlet panel according to claim 1, wherein:

the disassembly mechanism is disposed on a rear side of the panel seat, the water outlet seat is fixedly disposed with at least two of the connecting columns, the water outlet panel is disposed with at least two of the disassembly mechanisms, and the at least two of the disassembly mechanisms respectively correspond to the at least two of the connecting columns.

13. A water outlet panel assembly configured to be connected to a faucet, comprising:

the water outlet panel according to claim 1, and an adapter member, wherein:

the water outlet panel is detachably connected to a faucet body of the faucet, the adapter member comprises a water inlet, a first water outlet, and a second water outlet, the water inlet and the first water outlet are detachably connected to a water outlet pipe of the faucet, and the second water outlet is in communication with the one or more water outlet ports.

14. The water outlet panel assembly configured to be connected to the faucet according to claim 13, wherein:

the water outlet panel assembly further comprises a control member, the control member is connected to the second water outlet and the one or more water outlet ports of the water outlet panel to be configured to control the second water outlet alternatively to be or not to be in communication with the one or more water outlet ports, when the second water outlet is controlled to be in communication with the one or more water outlet ports by the control member, the first water outlet is controlled to be closed by the adapter member, when the second water outlet is controlled not to be in communication with the one or more water outlet ports by the control member, the first water outlet is controlled to be opened by the adapter member, the adapter member comprises a cavity, a movable switching member, and an elastic member, the cavity is respectively connected to the water inlet, the first water outlet, and the second water outlet, the movable switching member is movably disposed in the cavity to move between a first position for blocking the first water outlet and a second position for unblocking the first water outlet, the elastic member abuts the movable switching member, when the second water outlet is controlled not to be in communication with the one or more water outlet ports by the control member, the movable switching member is pushed by a water pressure in the cavity to overcome an elastic force of the elastic member so as to enable the movable switching member to be moved to the second position, when the second water outlet is controlled to be in communication with the one or more water outlet ports by the control member, the movable switching member is pushed by the elastic force of the elastic member to be moved to the first position, the movable switching member comprises a first bearing surface facing the second water outlet and a second bearing surface facing the first water outlet, and an area of the first bearing surface is larger than an area of the second bearing surface.

15. The water outlet panel assembly configured to be connected to the faucet according to claim 13, wherein:

the water outlet panel comprises a through hole penetrating therethrough, and a bottom of the faucet body of the faucet is configured to be connected to the through hole.

16. The faucet comprising the water outlet panel assembly according to claim 13.

17. The water outlet panel according to claim 4, wherein:

the at least one hook member is moved radially inward to release a connection to the at least one buckling surface.

* * * * *